US006478167B1

(12) United States Patent
Burgess

(10) Patent No.: US 6,478,167 B1
(45) Date of Patent: Nov. 12, 2002

(54) CONTAINER POSITIONING AND DISPLAYING SYSTEM AND ASSOCIATED METHODS

(76) Inventor: Robert Earl Burgess, 1881 SW. 76$^{th}$ La., Ocala, FL (US) 34474

( * ) Notice: Subject to any disclaimer, the term of this patent is extended or adjusted under 35 U.S.C. 154(b) by 0 days.

(21) Appl. No.: 09/496,719

(22) Filed: Feb. 2, 2000

(51) Int. Cl.$^{7}$ ..... A47F 1/04
(52) U.S. Cl. ..... 211/59.2; 211/74
(58) Field of Search ..... 211/59.2, 59.3, 211/74, 151, 153, 135; 206/446, 459.5, 775, 139; 312/42, 45, 72; D9/517, 520, 550, 300, 455; 221/27, 29, 151, 152, 156, 92; 215/400, 12.1

(56) References Cited

U.S. PATENT DOCUMENTS

| | | | | | |
|---|---|---|---|---|---|
| 353,600 | A | * | 11/1886 | Sloan | 206/446 |
| 2,325,224 | A | | 7/1943 | Bryant, Sr. | 206/44 |
| 3,006,461 | A | | 10/1961 | McGinnis | 206/45.31 |
| 3,321,096 | A | | 5/1967 | Hebel | 215/1 |
| 4,042,096 | A | * | 8/1977 | Smith | 211/49.1 |
| 4,116,350 | A | * | 9/1978 | Allasia | 215/31 |
| D254,235 | S | * | 2/1980 | Hartung | D9/18 |
| 4,782,945 | A | | 11/1988 | Geiler et al. | 206/203 |
| 4,809,855 | A | * | 3/1989 | Bustos | 211/59.2 |
| 4,928,841 | A | | 5/1990 | Arthurs | 220/21 |
| 4,993,565 | A | * | 2/1991 | Ota et al. | 215/1 C |
| 4,997,094 | A | | 3/1991 | Spamer et al. | 211/153 |
| 5,199,584 | A | * | 4/1993 | Fowler et al. | 211/184 |
| 5,598,941 | A | | 2/1997 | Semersky et al. | 215/384 |
| 5,645,176 | A | * | 7/1997 | Jay | 211/59.2 |
| D383,067 | S | * | 9/1997 | Gower et al. | D9/540 |
| 5,695,075 | A | * | 12/1997 | Flum et al. | 211/59.2 |
| 5,806,712 | A | | 9/1998 | Siemsen et al. | 221/67 |
| 5,862,923 | A | * | 1/1999 | Nordquist et al. | 211/59.2 |
| 5,896,898 | A | | 4/1999 | Crossdale et al. | 141/83 |
| 5,992,650 | A | * | 11/1999 | Lord | 211/59.2 |
| 6,237,784 | B1 | * | 5/2001 | Primiano | 211/59.2 |

FOREIGN PATENT DOCUMENTS

| | | |
|---|---|---|
| IT | 318198 | 9/1935 |

* cited by examiner

*Primary Examiner*—Daniel P. Stodola
*Assistant Examiner*—Jennifer E. Novosad
(74) *Attorney, Agent, or Firm*—Allen, Dyer, Doppelt, Milbrath & Gilchrist, P.A.

(57) ABSTRACT

A system and methods for positioning containers in a container display rack preferably include a container display rack array having a container rotation track stop and a plurality of containers including container rotation stop members. The container rotation track stops are positioned adjacent a common container track along which each of the plurality of containers advance in a forward path of travel to a forwardly extending dispensing area. The containers include one or more container rotation stop members each having one or more grooves formed in arcuate portions of each of the plurality of containers positioned to slidably engage the rotation track stops to prevent rotation of each of the plurality of containers as the containers advance in a forward path of travel to the forward dispensing area. The system and methods advantageously allow each of the containers to advance without rotating to the forward most portion of the forward dispensing area when the forward most container is removed.

36 Claims, 8 Drawing Sheets

CONTAINER POSITIONING AND DISPLAYING SYSTEM AND ASSOCIATED METHODS

FIELD OF INVENTION

This invention is related to the container dispensing industry and, more particularly, to the field of positioning and displaying containers and associated methods.

BACKGROUND OF THE INVENTION

Manufacturers of beverages or any product sold in a substantially cylindrical container spend considerable time in positioning a label on the container to advertise their product. The label positioned on the container is very important because it aids the consumer in making a decision as to which container to purchase. It is believed, for example, that many consumers are more likely to purchase a beverage in a container that they can readily identify. If the consumer cannot identify the beverage because the label is not visible or easily recognizable, then the consumer is less likely to purchase the beverage.

A current problem with container dispensing systems, as shown in U.S. Pat. No. 4,997,094 by spamer et al. titled "Composite Organizer Shelf," however, is that when a container is loaded into such a container rack and travels forward to the dispensing area, the container rotates and the label is not properly positioned so as to face potential customers viewing the container in the forward dispensing area. This problem is made more complex when there is a plurality of containers positioned in the container dispensing rack.

Accordingly, beverage producers or manufacturers in the container dispensing industry currently address the problem of rotation of containers in display racks by hiring persons or using current personnel to go to convenience stores, gas stations, grocery stores and anywhere else that container display racks are used and manually turn the containers so that the labels positioned on the containers can be readily viewed by a potential or actual customer in the forward dispensing area. Retailers often do not manually rotate the containers because the retailer does not have the same vested interest in selling a particular brand or manufacturer.

Problems with this manual label positioning solution, for example, include that it is timely, very expensive and presents only a temporary solution. The cost of hiring persons or using current personnel to go from store to store to simply position labels on containers positioned in a display rack are very high as well as time consuming. The persons who manually turn the containers also often only turn the first row of containers so that labels face in a forward direction towards the forward dispensing area. When a container positioned behind the forward most container advances to the forward dispensing area the container will rotate and the label again will not be positioned in a forward direction. Another problem with this proposed solution is that a person who rotates the container will not be able to align the labels precisely to result in a uniform position of the labels affixed to the container.

Examples of devices developed to prevent rotation of a single container when positioned in a rectangular box can be seen in U.S. Pat. No. 3,006,461 by McGinnis titled "Packaged Bottle with Rotation Preventing Insert Member," and U.S. Pat. No. 2,325,224 by Bryant titled "Bottle Holder." These devices, however, only prevent rotation of a single bottle in a single rectangular box to thereby allow the label on the bottle to show through a viewing area of the box such as when the box is positioned on a shelf. These devices likewise do not address or recognize problems associated with display racks for a plurality of containers.

SUMMARY OF THE INVENTION

In view of the foregoing, the present invention advantageously provides a container display rack system and methods to prevent rotation of arcuate shaped portions of a container positioned in a container display rack array system. This system advantageously allows for labels affixed to containers to remain in a forwardly viewable direction while positioned in the container display rack array. This is very important for container manufacturers because it provides a customer with a way of identifying the manufacturer's product. The containers are advantageously serially aligned within each container rack. Container racks can also advantageously be positioned in a side-by-side relationship so as to provide a plurality of serially aligned columns of containers positioned in the container display rack array.

There are several advantages to utilizing this type of container rotation preventing system. For example, the system provides the container dispensing industry with a fast economical way to insure that the labels affixed to containers face in a forwardly direction to be readily viewed by customers positioned in a forward dispensing area. The system eliminates the need for manual rotation of containers positioned in a conventional container display rack which have rotated so as not to be serially aligned in the container rack. The rotation prevention technique utilized in this system and methods also advantageously cuts down on loading time. A person hired to load containers into a conventional display rack is responsible for inserting the containers into the display rack and then rotating the forward most containers to insure that the labels positioned on the forward row of containers face in a forward direction to be readily viewable by customers in the forward dispensing area. A person hired to load containers into a container rotation preventing system can simply load the containers into the container display rack and since the containers will not rotate as they travel to the forward dispensing area, e.g., by gravity force, the person loading the containers will not need to take extra time to rotate the containers to face in a forward position towards the viewing area.

The container rotation prevention technique also advantageously includes kits which can be ordered from the manufacturer to attach to conventional container display racks. Individual container display rack adaptors can readily be inserted into a conventional container display rack to prevent rotation of containers positioned in the container display rack. This makes the transformation from a conventional container display rack system to the system that prevents rotation very inexpensive. The container rack adaptors also advantageously allow for only certain racks in an array to be adapted to use the rotation prevention technique and others to use the conventional container dispensing technique, depending on the needs of the owner.

The container rotation prevention technique still further advantageously includes another embodiment of a rack insert positioned to overly the container rotation preventing track stops to allow for conventional containers to be used in the new container rack. This insert allows for any type of container to be used with the container rotation prevention system depending on the needs of the owner.

Another advantageous embodiment of the container rotation prevention technique is removable container track stops. The track stops positioned on a common container track may be removed by the owner of the display rack to allow for containers which do not include container rotation stop members to readily travel along the container track to the forward dispensing area.

The impact of the label on the consumer is a very important marketing edge for the container manufacturers. A label will more likely affect the decision of a consumer viewing such label from the forward dispensing area only if the label is readily viewable to the consumer. If the consumer cannot view the label due to the problem of container rotation, the marketing edge is lost. The container display rack system optimizes the time and efforts of marketing a product.

A container display rack array system according to the present invention preferably includes a rack having a forwardly extending dispensing area and a common container track along which a container travels forward to the forwardly extending dispensing area. The track preferably includes at least one container rotation track stop for stopping rotation of the container when positioned along the container track and at least one container positioned in the rack having an arcuate shaped portion thereof and at least one container rotation stop member positioned to slidably engage the container rotation track stop of the container track so that rotation of the container is prevented when positioned in the display rack.

The present invention also advantageously provides a gravity fed display rack array having a plurality of racks each positioned adjacent at least one other rack in a side-by-side relationship so that the plurality of racks in combination define a plurality of columns and rows when a plurality of containers are positioned therein. The gravity fed display rack also has a forwardly extending dispensing area defined by forward portions of each of the plurality of columns of the racks so that when a plurality of containers is positioned in each of the columns gravity force allows the containers to move forwardly when one of the containers is removed from one of the columns of the dispensing area. Each rack includes a common container track along which a plurality of containers serially align. The common container track includes container rotation stopping means for stopping the rotation of each container when positioned along the container track.

The present invention further advantageously provides a container positioned in the rack having an arcuate shaped portion and at least one container rotation stop member positioned to slidably engage a container rotation track stop to prevent rotation of the container when the container is positioned in the display rack. The rotation stop member is preferably formed into, connected to, or associated with the arcuate portion of the container which otherwise has a tendency to rotate.

The present invention also advantageously provides a method of dispensing at least one container positioned in a display rack system. The method preferably includes guiding the at least one container along a common container track to the forward dispensing area, preventing rotation of the at least one container by slidably engaging portions of the at least one container with portions of the common container track, and stopping travel of the at least one container so that a substantially complete front portion of a label positioned on the at least one container is positioned adjacent the forward most portion of the dispensing area.

The present invention still further advantageously provides a method of loading at least one container into a container display rack. The method preferably includes loading the at least one container includes positioning said container in the container display rack and engaging at least one container rotation stop member positioned on an arcuate shaped portion of the at least one container with at least one container rotation track stop positioned adjacent the common container track. Once the container has been loaded so as to engage the container rotation stop member with the container rotation track stop, the container can advantageously slide along the common container track free of rotation and come to a resting position at the forwardly extending dispensing area.

By providing a container display rack system which prevents rotation of containers positioned in a display rack the container dispensing industry, more specifically, the beverage container industry, can inexpensively insure that the resources spent on the marketing and placing of a label upon a container are not wasted due to the fact that containers are rotated in a display rack so as not to allow the labels on the containers to be visible.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. The prime and double prime notation, if used, indicates similar elements in alternative embodiments.

Figure 1:
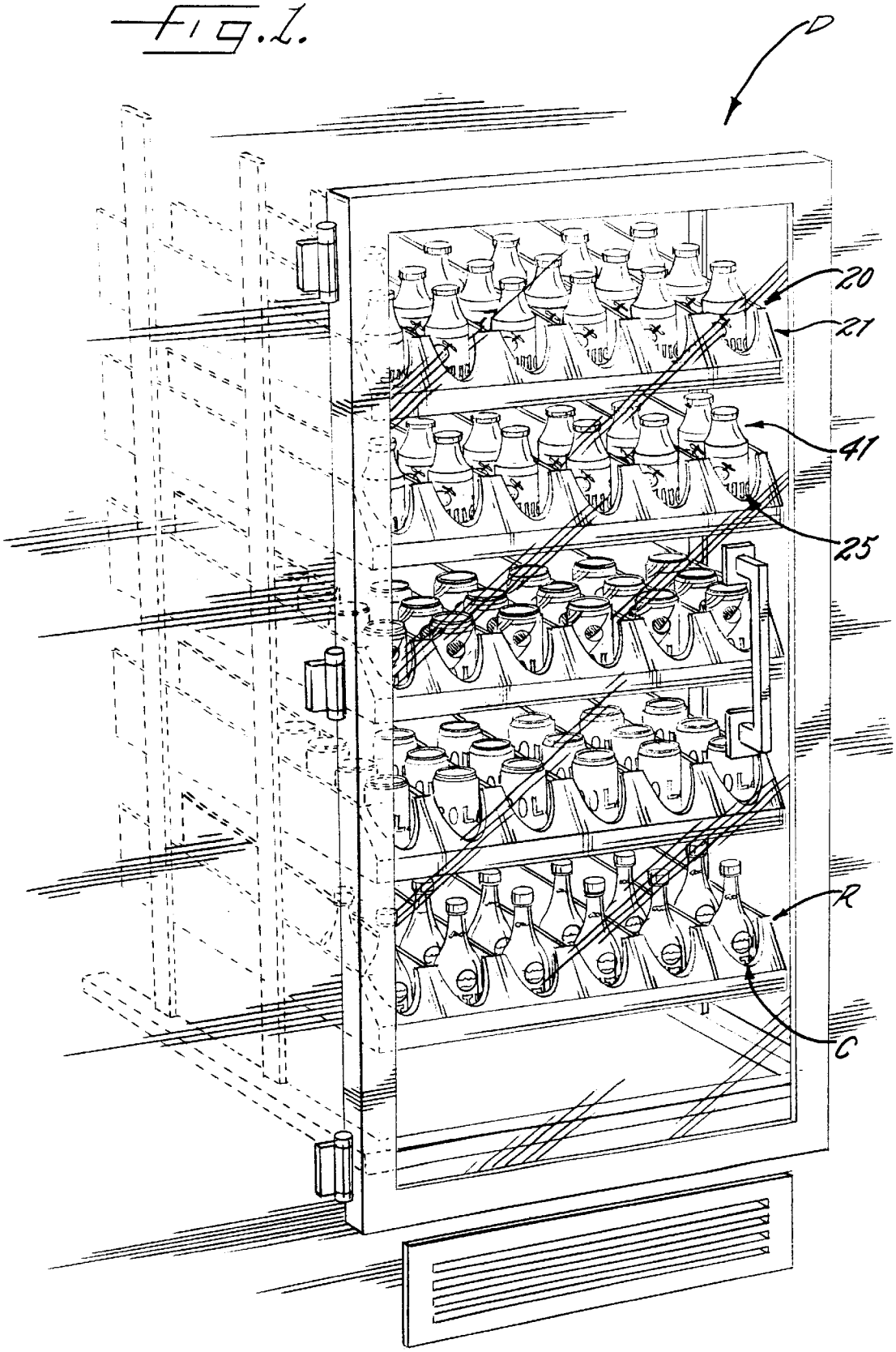
FIG. 1 is a perspective environmental view of a container display rack system according to the present invention showing that a plurality of different types of containers can be positioned in the container display rack system.
Figure 2:
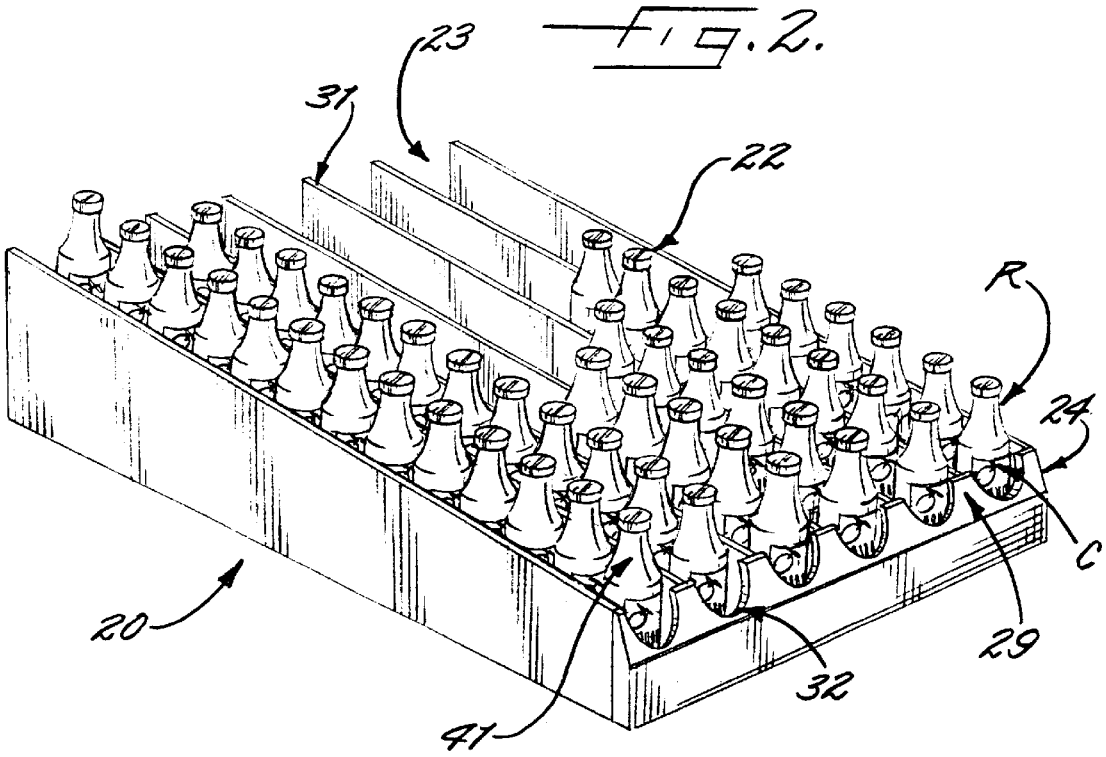
FIG. 2 is a perspective view of a container display rack array and having a plurality of containers serially aligned in each rack according to the present invention.
Figure 9:
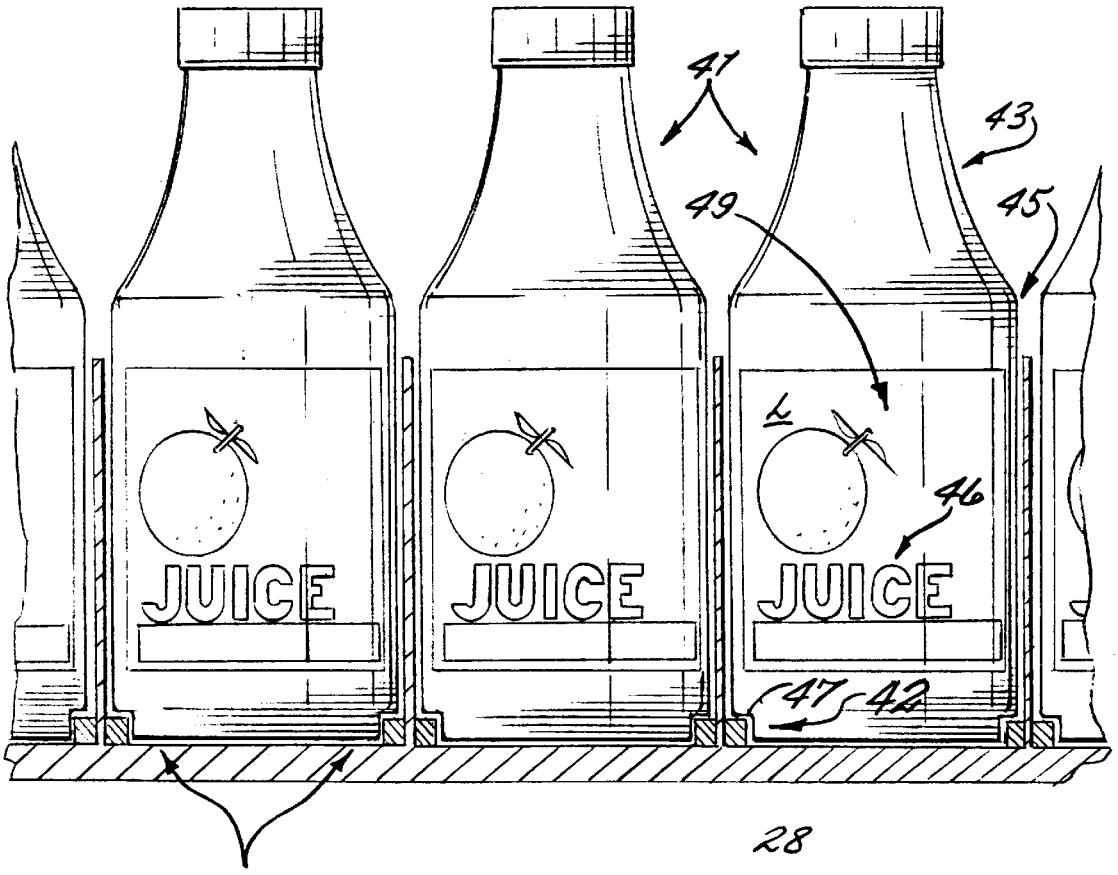
FIGS. 9–11 are front elevation views of a plurality of various containers in the forward dispensing area serially aligned so that the labels positioned on a container are readily viewable by a customer in a forward dispensing area.
Figure 10:
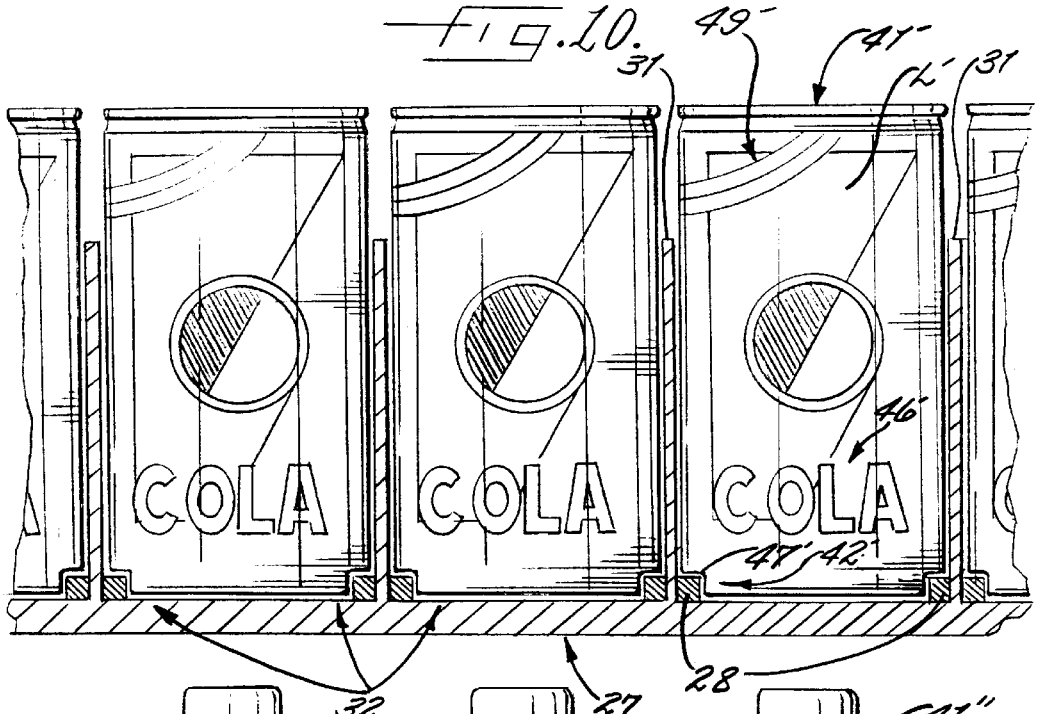
Figure 11:
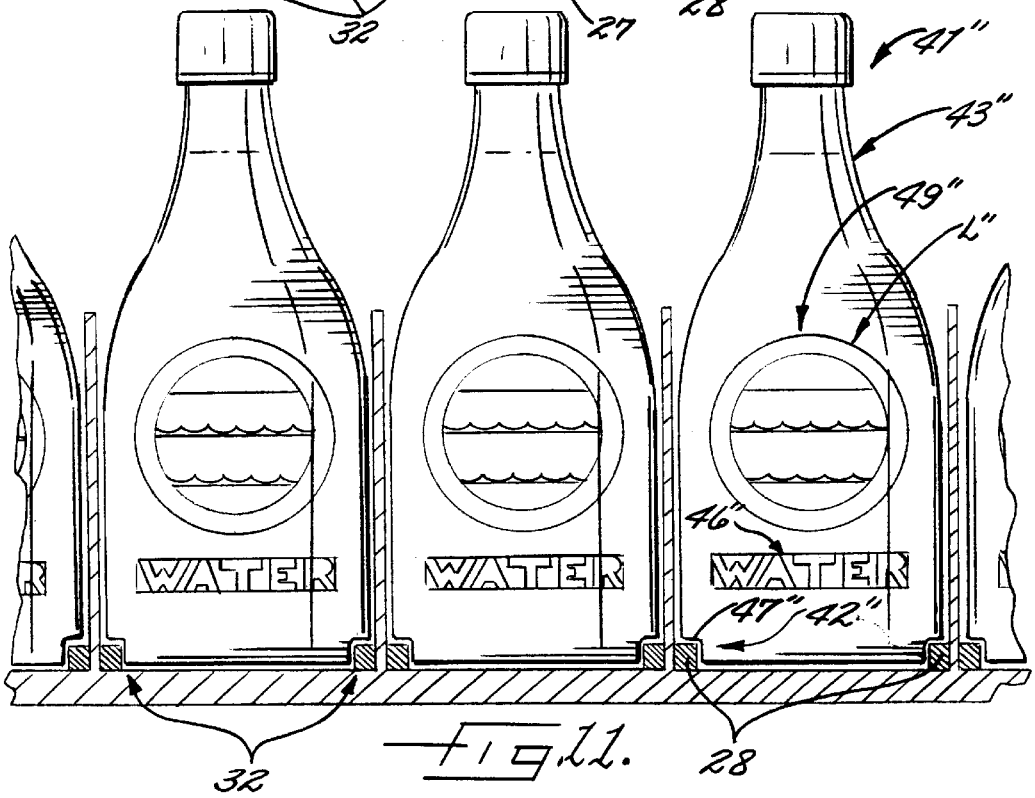

FIGS. 1–2 illustrate a container display rack array system 20 in a display case D which has a plurality of display rack arrays 22 in a spaced-apart and substantially vertical configuration according to the present invention. The display rack arrays 22 are suited to retain and prevent rotation of many types of containers 41, differing in both size and shape, such as bottles of plastic or glass or cans of metal or metal alloys (see also FIGS. 9–11). FIG. 1 illustrates six columns C of containers. Various numbers of columns C, e.g., such as nine as often used in such displays as understood by those skilled in the art, can be used as well according to the present invention.

The display case D is normally situated to include a plurality of display rack arrays 22 positioned to allow consumers to readily view serially aligned containers 41 in a viewing area 21. The display case D may have a glass door through which a potential or actual customer may view the serially aligned containers 41, which may be opened to give customers access to the containers 41, or through which retailers, distributors, or manufacturers can load the display rack arrays 22. Alternatively, the display case D may be open to give the customer easier access to the containers 41 positioned in the container display rack array system 20.

A container display rack array system 20 (e.g. as seen in FIG. 2) to prevent rotation of arcuate shaped portions of containers 41 positioned in a container display rack 25 preferably includes at least one display rack array 22 and at least one container 41. The cooperation of the at least one container 41 and the display rack array 22 prevents rotation of containers 41 as the containers advance in a forward path of travel to a forwardly extending dispensing area 24. The container display rack array 22 has a plurality of container racks 25 which are positioned adjacent one another in a side-by-side relationship so that a plurality of racks 25 in combination define a plurality of columns and rows when a plurality of containers 41 is positioned therein. Each rack 25 in the display rack array 22 includes a common container track 27 along which the plurality of containers 41 serially align (see also FIGS. 3–4 and 8). The common container track 27 includes container rotation stopping means for stopping the rotation of each of a plurality of containers 41 when positioned along the container track 27.

Figure 6:
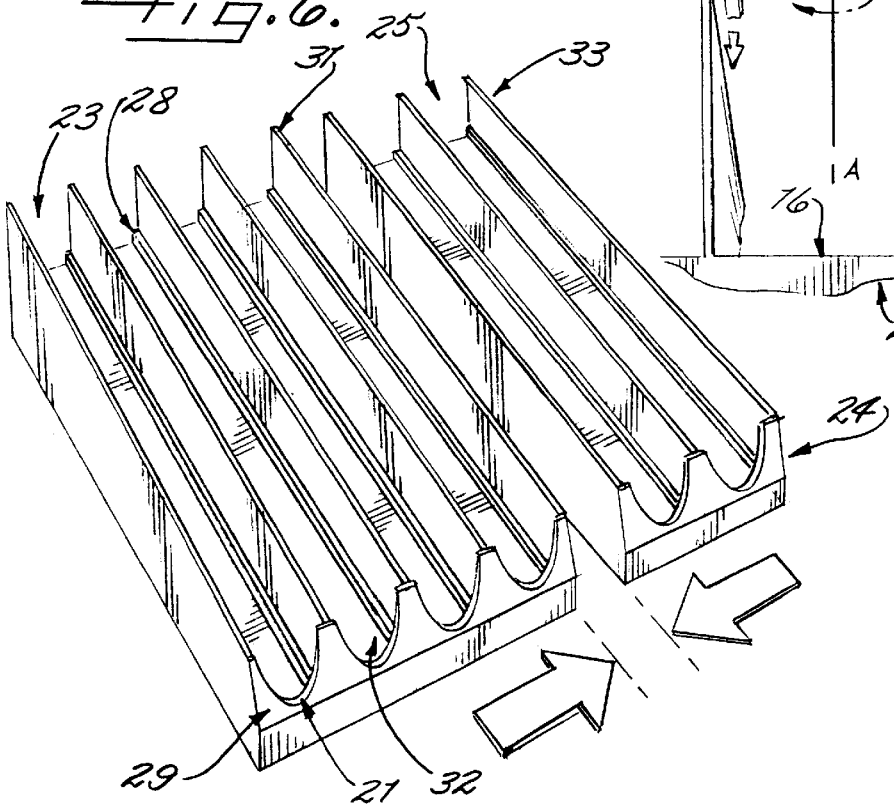
FIGS. 6–7 are exploded views of a plurality of container display rack arrays of different sizes positioned adjacent one another according to the present invention.
Figure 7:
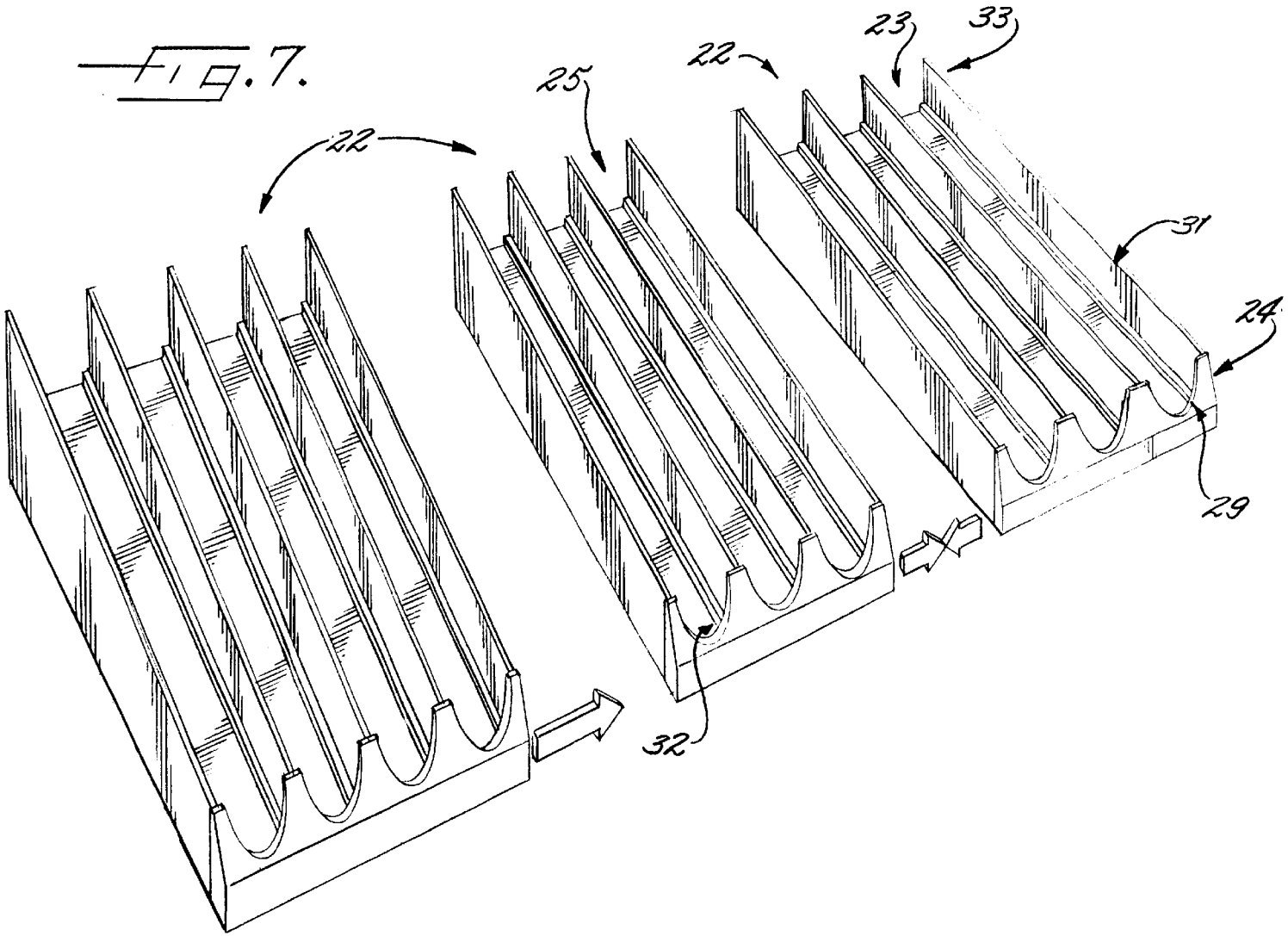

The plurality of container display racks 25 positioned in the display rack array 22, for example, can be separated by a sidewall 31. The sidewall 31 provides stability to the containers 41 as the containers 41 advance to the forwardly extending dispensing area 24. The sidewall 31 extends longitudinally the length of the container rack 25 (see also FIGS. 2 and 6–7)

Figure 5:
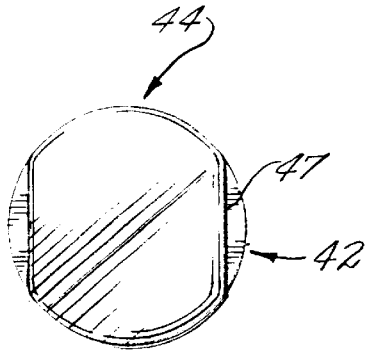
FIG. 5 is a bottom plan view of a bottom of a container showing the container rotation stop members formed in a substantially cylindrical portion of the container and extending substantially the length of the container according to the present invention.
Figure 4:
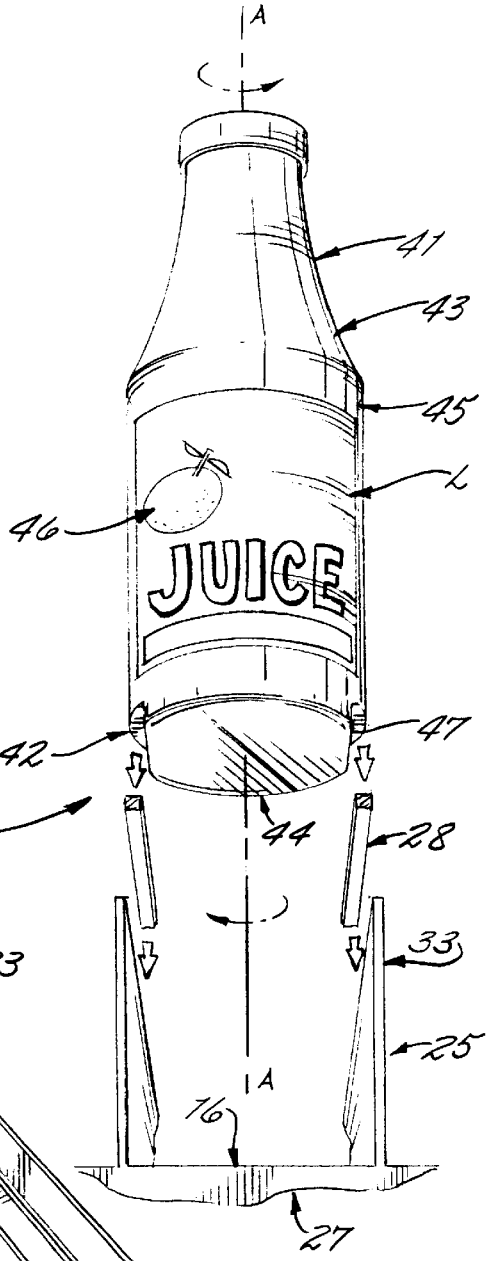
FIG. 4 is an exploded view of container rotation stop members positioned on a substantially cylindrical shaped portion of a container matingly engaging track stops positioned along a common container track according to the present invention.

As perhaps best shown in FIGS. 4–5, the at least one container 41 having an arcuate shaped portion, e.g., preferably substantially cylindrical in shape, is positioned in the display rack array 22. The at least one container 41 has at least one rotation stop member 42 formed in the arcuate shaped portion of the container 41. The at least one rotation stop member 42 matingly engages the container rotation stopping means to prevent rotation of the at least one container 41 as the container moves in a forward direction along the common container track 27 towards the forwardly extending dispensing area 24.

Figure 8:
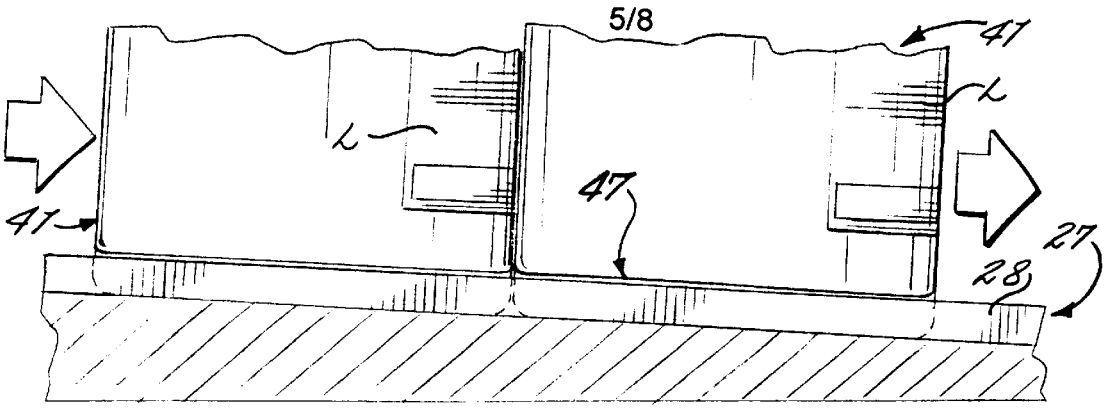
FIG. 8 is a sectional view of a container display rack having serially aligned labels positioned on the containers as the containers travel in a forward direction by gravity force toward a forward dispensing area according to the present invention.

The container rotation stopping means associated with the common container track 27 is preferably provided by at least one track stop 28 extending longitudinally toward the forward dispensing area 24 along the common container track 27 positioned to matingly engage each of the plurality of containers 41 to prevent rotation of arcuate shaped portions of each of the plurality of containers 41. For example, the arcuate shaped portions, which may be substantially cylindrical can be positioned along the bottom, top, medial, or other selected portions of the container, would otherwise have a tendency to rotate during travel, e.g., sliding by gravity force such as shown in FIG. 8, along the track 27. The container rotation stopping means may also advantageously have first and second track stops 28 positioned substantially parallel and spaced-apart from one another and positioned to slidably engage the at least one container rotation stop member 42 of the container 41 to prevent rotation of the container 41 as it travels in a forward direction along the common container track 27 towards the forwardly extending dispensing area 24.

The common container track 27 also includes a bottom support member 26 connected to the substantially parallel track stops 28. The bottom support member 26 abbutingly contacts and supports a bottom portion 44 of each of the plurality of containers 41 to slidably engage each of the plurality of containers 41 to prevent rotation of the containers 41 as the containers 41 advance in a forward path of travel to the forwardly extending dispensing area 24.

The at least one container rotation stop member 42 is made up of at least one groove 47, i.e., and preferably a pair of grooves for stability and guidance, formed in an arcuate shaped portion of the container 41 and extending substantially the length of a bottom portion 44 of the at least one container 41 (see FIGS. 4 and 9–11). The groove 47 can be formed in the bottom portion 44 of the container 41 having a substantially cylindrical shape and positioned to slidably engage the rotation track stops 28 positioned along the common container track 27. The container rotation stop member 42 may also advantageously be a pair of grooves 47 extending substantially the length of the bottom portion 44 of the container 41 to enhance guiding the container 41 along the common container track 27 to the forward dispensing area 24.

The at least one groove 47 of the container rotation stop member 42 slidably engages the at least one rotation track stop 28 to prevent rotation of the at least one container 41 as said container 41 advances in a forward path of travel to the forward dispensing area 24 of the container rack 25. Likewise, the pair of grooves 47 comprising the rotation stop member 42 extending substantially the length of the bottom portion 44 of the at least one container 41 slidably engage the pair of substantially parallel track stops 28 to prevent rotation of the at least one container 41 as said container 41 advances in a forward path of travel to the forward dispensing area 24 of the container rack 25.

The container display rack array 22 may also advantageously utilize gravity force to advance containers 41 positioned within the display rack array 22. The container display rack array 22 has a forwardly extending dispensing area 24 defined by forward portions of each of the plurality of columns C of the container racks 25 so that when a plurality of containers 41 is positioned in each of the columns C, gravity force allows the containers 41 to advance forwardly when one of the containers 41 is removed from one of the columns C (see FIG. 8).

The container display rack array 22 also includes a forward stop member 29 positioned along a forward path of travel of the at least one container 41. The forward stop member 29 is preferably defined by the forward most portion 32 of the container display rack array 22 to thereby stop the forward travel of the at least one container 41 along the common container track 27 as the container 41 advances to a position adjacent the forward dispensing area 24.

The at least one container 41 includes a label L with indicia 46 positioned on the label L (see also alternative embodiments of containers 41', 41", 41'" and alternative embodiments of labels L', L", L'"). The indicia 46 on the label L of the at least one container 41 faces forward when the at least one container 41 is inserted into the container rack 25 and remains in a forward position when the at least one container 41 is removed from the forward dispensing area 24.

The container display rack array system 20 may also utilize a plurality of containers 41. The plurality of containers 41 positioned in the display rack array 22 are serially aligned in each of the container racks 25 and are separated by a sidewall 31 which makes up each of the display rack arrays 22. When the plurality of containers 41 advances by gravity force to the forward dispensing area 24 the indicia 46 positioned on the labels L on each of the plurality of containers 41 along the forward most row R will face in a forward direction to be readily viewed by a customer located in the forward dispensing area 24.

The plurality of containers 41 are positioned in the container display rack array system 20 to matingly engage portions of the common container track 27. The rotation stop members 42 defined by a pair of grooves 47 formed in the bottom portion 44 of each of the plurality of containers 41 slidably engage the rotation stopping means defined by parallel track stops 28 positioned along the common container track 27 to prevent rotation of each of the plurality of containers 41 as said containers 41 advance by gravity force to the forward dispensing area 24. The forward stop member 29 stops forward motion of each of the plurality of containers 41 when said containers 41 reach the position of the forward dispensing area 24 defined by the forward most portion 32 of the container display rack array 22.

The components of the container display rack array system 20 may also be utilized in a labeling process. The labeling process, for example, can include the steps of loading a plurality of containers 41 onto a common container track 27 and advancing the plurality of containers 41 into a labeling apparatus. The plurality of containers 41 travel through the container labeling system, and a label L is affixed to each of the plurality of containers 41 at some point in the process. The container labeling system can easily and inexpensively be modified to utilize the container rotation preventing system including the rotation track stops 28 associated with the common container track 27 and the rotation stop members 42 associated with the containers 41. The containers 41, including the rotation stop members 42 defined by a pair of grooves 47 formed in a bottom portion 44 of each of the containers 41, are positioned to matingly engage the rotation track stops 28 attached to the common container track 27 which retains the containers 41 as the containers 41 enter the labeling process. The labels L are affixed to each of the plurality of containers 41 uniformly due to the prevention of rotation provided by engagement of the container rotation stop member 42 defined by grooves 47 formed in a bottom portion 44 of the container 41 and the container track stops 28 positioned along the common container track 27 which retains each of the plurality of containers 41 (see also containers 41', 41", 41'" and labels L',L", L'") as the containers 41 advance through the labeling process.

As perhaps best illustrated in FIGS. 12–17, the present invention can also advantageously be accomplished by the use of a container rotation preventing adaptor 50 according to another embodiment of the present invention. The container rotation preventing adaptor 50 can then form a portion of a system which allows an end user to select some or all of the racks of a system, a shelf, or an array of racks to prevent rotation of the containers therein.

Figure 12:
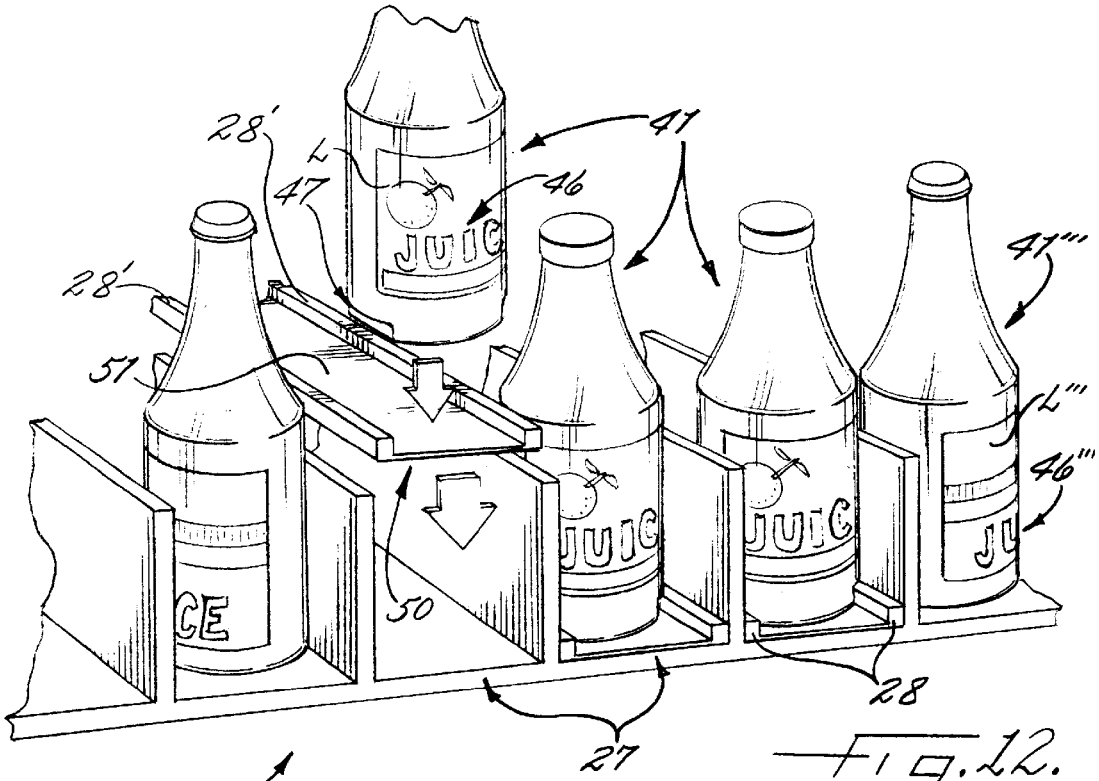
FIG. 12 is perspective view of a common container track adaptor in a conventional container display rack array according to another embodiment of the present invention.
Figure 13:
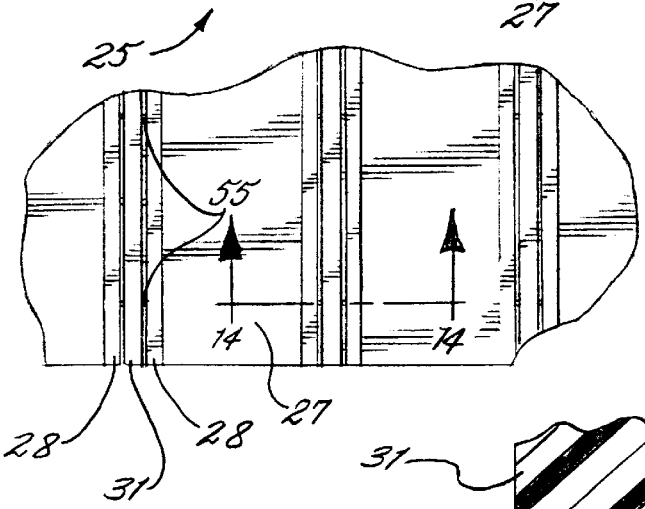
FIG. 13 is a top plan view of a plurality of container display racks including removable track stops according to another embodiment of the present invention.
Figure 14:
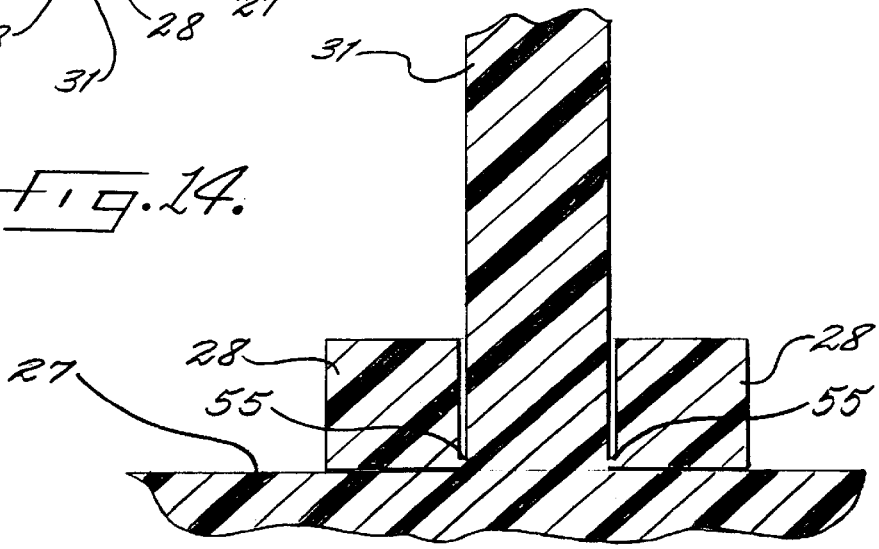
FIG. 14 is a sectional view of a portion of the plurality of container display racks taken along line 14—14 of FIG. 13 and showing the attachment of the removable track stops according to the present invention.
Figure 15:
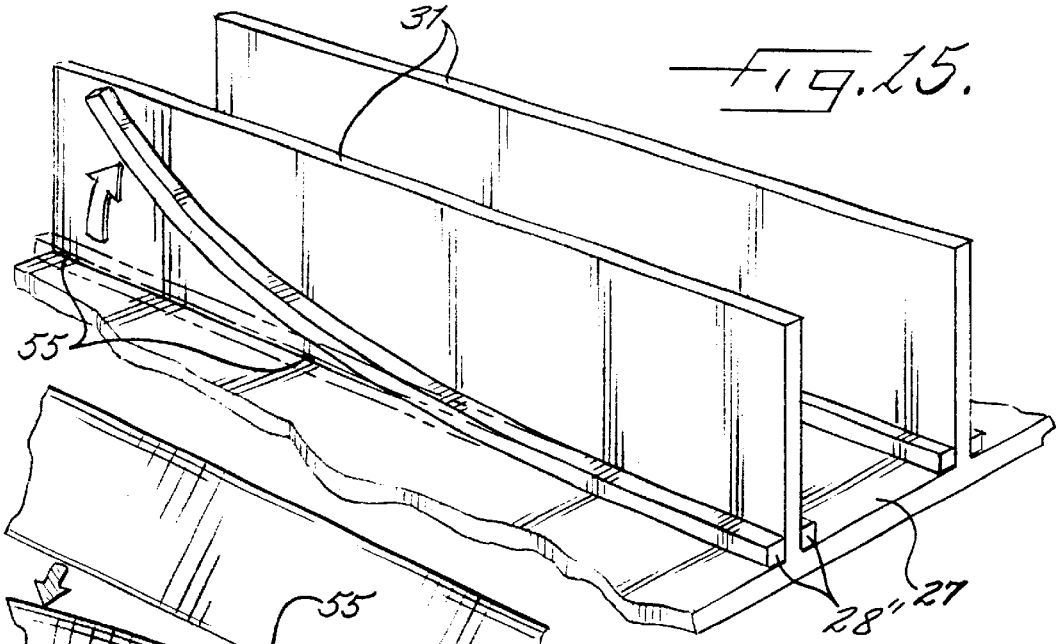
FIG. 15 is a perspective view of a plurality of container display racks showing the removal of track stops according to the present invention.
Figure 16:
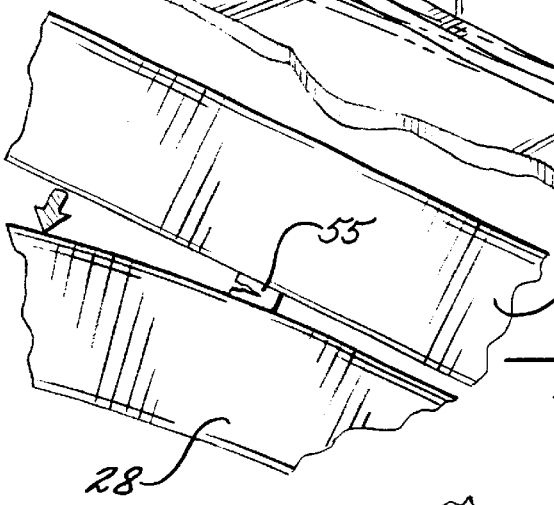
FIG. 16 is a fragmentary top plan view showing the separation of the removable track stops according to the present invention.
Figure 17:
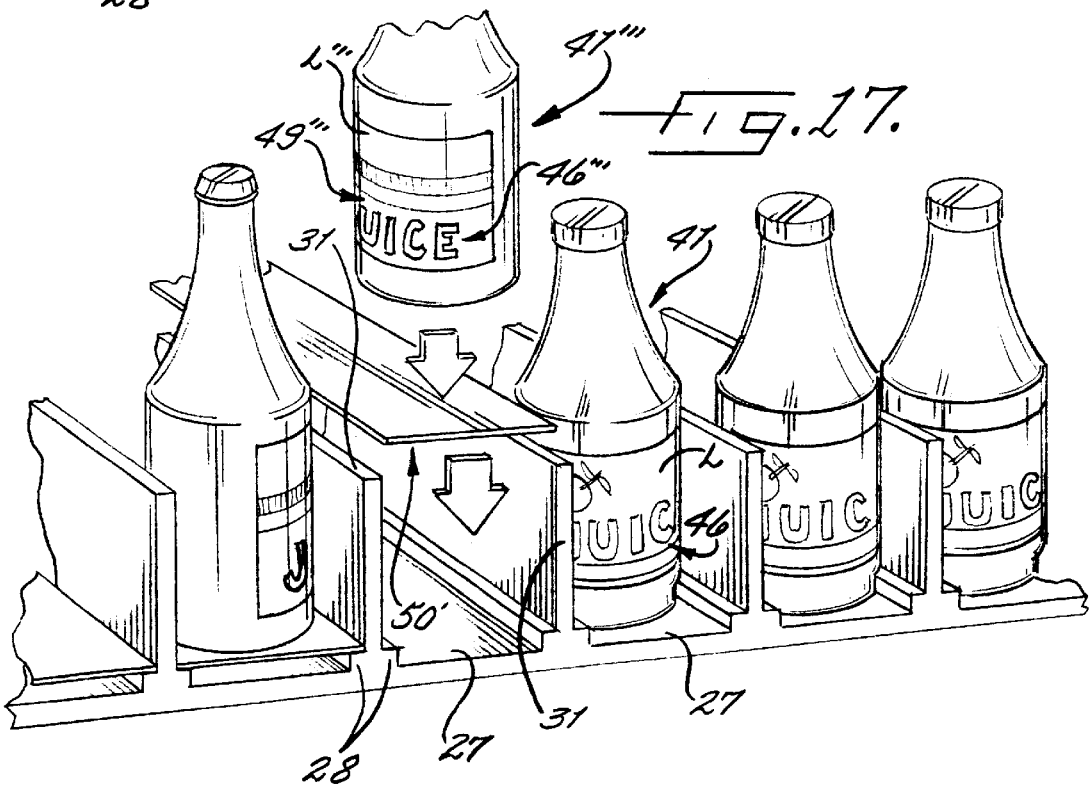
FIG. 17 is an exploded perspective view showing another embodiment of an adaptor to be placed into the container display rack to allow for the use of conventional containers in the rotation preventing system according to the present invention.

A container rack system according to an embodiment of the present invention preferably prevents the rotation of arcuate shaped portions of containers positioned in the rack. The system preferably has a container rack having a forwardly extending dispensing area defined by the forward most portion of the container rack and a common container track along which at least one container travels to the forwardly extending dispensing area. At least one container, and more preferably a plurality of containers, is positioned in the rack. Each of containers has an arcuate shaped portion thereof. A container rotation preventing adaptor 50, such as illustrated in FIG. 12, is preferably positioned in the rack to stop the rotation of the arcuate shaped portion of the at least one container as the at least one container travels forward to the forwardly extending dispensing area. A bottom portion of the container rotation preventing adaptor 50 slidably and abuttingly contacts an upper surface of the rack. The container rotation preventing adapter 50, like other embodiments of the present invention discussed herein, preferably includes at least one track stop member 28' which matingly engages a portion of the at least one container. The track stop member 28' is preferably connected to a substantially planar bottom portion 51 of the adaptor 50 as illustrated. The portion of the at least one container includes at least one container rotation stop member 47 positioned to matingly engage the track rotation stop member 28' so that the at least one container slidably advances on the track and rotation of the at least one container is prevented. Other embodiments of the same concept which allows only selected racks to have rotation preventing features, for example, can be provided by having the track stop members readily detach from the rack by the use of a break-away member 55, e.g., a plastic or other material which forms a leg to secure the track to the rack, e.g., side or bottom portions, so that the selected rack or racks do not require rotation prevention (see FIGS. 13–16). In other words, the track stop member 28 can be separated or broken away from the other portions of the rack to provide an unblocked or uninhibited surface (see FIGS. 15–16) upon which beverages or other containers can be mounted. Also, another embodiment of an adaptor 50' which is substantially planar can be positioned to overlie and abuttingly contact portions of the racks which have rotation preventing features (see FIG. 17) to likewise allow other types of containers, e.g., rectangular bottoms for milk cartons or the like, to be used in a side-by-side relationship. These embodiments advantageously allow the retailers of the merchandise, e.g., drinks or beverages, to have more control over the displaying system and positioning of beverages as desired.

As illustrated in FIGS. 1–17, the present invention also advantageously provides methods of displaying, guiding, preventing rotation, stopping, dispensing and loading of each of a plurality containers 41 as the containers 41 are positioned in the container display rack array system 20. The method of displaying the plurality of containers 41 includes the step of guiding each of the plurality of containers 41 along a common container track 27. The step of guiding each of the plurality of containers 41 along the common container track 27 includes advancing the plurality of containers 41 in a forward path of travel towards a forward dispensing area 24 by gravity force as shown in FIG. 8. The guiding step is enhanced by sidewalls 31 positioned along the container rack 25 for stabilizing each of the plurality of containers 41 as the containers 41 advance in a forward path of travel to the forward dispensing area 24.

The method of preventing rotation is provided by slidably engaging the plurality of containers 41 with portions of the common container track 27. This method further includes the container rotation stop members 42 defined by grooves 47 positioned on an arcuate shaped portion of each of the plurality of containers 41 slidably engaging track stops 28 positioned adjacent the common container track 27. The grooves 47 formed in the arcuate shaped portion of each of the plurality of containers 41 can alternatively be formed in a substantially cylindrical bottom portion 44 of each of the plurality of containers 41.

The method of stopping forward travel of each of the plurality of containers 41 positioned along the common container track 27 can include the step of abbutingly contacting a forward stop member 29 positioned in the forward most portion 32 of the forward dispensing area 24. The forward most of each of the plurality of containers 41 abbutingly contact the forward stop member 29 to stop forward travel of the serially aligned plurality of containers 41, and forming the forward most row R of containers 41 with serially aligned labels L readily viewable to customers positioned in the forward dispensing area 24.

The method of dispensing each of the plurality of containers 41 includes the step of advancing the plurality of containers 41 to the forward dispensing area 24, removing the forward most of the plurality of containers 41 positioned in the forward dispensing area 24 and advancing the container 41 positioned directly behind the previously removed forward most container 41 to the forward most position 32 of the display rack array 22 by gravity force once the forward most container 41 is removed from the container display rack array 22.

The method of loading each of the plurality of containers 41 into the container display rack array 22 includes loading each of said containers 41 into a loading area 23 defined by the rear most portion 33 of the container display rack 25. It will also be understood by those skilled in the art that the container display rack can be loaded from a forward most portion of the display rack as well according to the present invention. In other words, some display rack arrays or dispensing areas only have a door or open region for loading the front and do not have a door or open region for loading the back. Others will have both, but either way, the present invention can advantageously enhance or improve the loading process.

The method of loading each of the plurality of containers 41 further includes positioning each of the plurality of containers 41 in the loading area 23 defined by the rear most portion 33 of the container rack 25 and engaging the container rotation stop members 42 defined by grooves 47 formed in the bottom cylindrical portion 24 of each of the plurality of containers 41 with the track stops 28 positioned adjacent the common container track 27.

Figure 3:
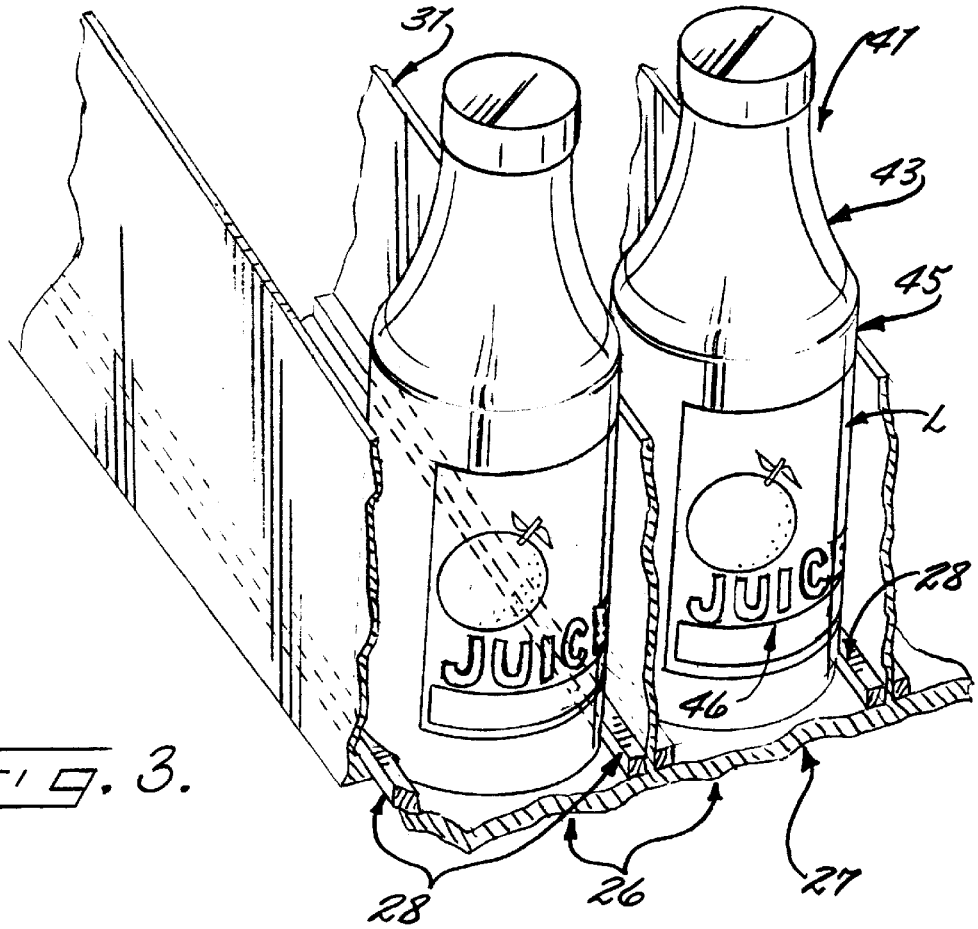
FIG. 3 is a fragmentary perspective view of a plurality of containers having rotation stop members slidably engaging a plurality of common container tracks having track stops according to the present invention.

A method of displaying containers is also provided as perhaps best shown in FIGS. 1–3. The method preferably includes preventing rotation of a plurality of containers in a retail merchandising display as the containers advance to a forward most dispensing area of the display. The method can also include the step of maintaining a label on each of the plurality of containers in a forward facing direction as each of the plurality of containers advance to the forward most dispensing area.

The method can still also include the label having indicia thereon, and the indicia on the label also being maintained in a forward facing direction. Each of the plurality of containers, as illustrated (see FIG. 4, has a bottom and a substantially vertical axis A—A extending through the bottom of the container 41. The step of preventing rotation can advantageously include preventing rotation about the vertical axis of each of the plurality of containers.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. In combination, a plurality of containers and a container display rack system to prevent rotation of arcuate shaped portions of each of the plurality of containers, the system comprising;

a gravity fed display rack array having a plurality of racks each positioned adjacent at least one other rack in a side-by-side relationship so that the plurality of racks in combination define a plurality of columns and rows when the plurality of containers are positioned therein, the gravity fed display rack array also having a forwardly extending dispensing area defined by forward portions of each of the plurality of columns of the plurality of racks so that when thee plurality of containers are positioned in each of the columns gravity force allows each of the plurality of containers to move forward when one of the plurality of containers is removed from one of the columns of one of the plurality of racks at the forwardly extending dispensing area, each of the plurality of racks including a common container track along which the plurality of containers serially align, the common container track including container rotation stopping means for stopping the rotation of each of the plurality of containers when positioned along each of the common container tracks, the container rotation stopping means including first and second substantially parallel and spaced-apart track stop members extending longitudinally toward the forwardly extending dispensing area along the common container track and positioned to matingly engage the plurality of containers to prevent rotation of the plurality of containers;

said plurality of containers positioned in each of the plurality of racks of the gravity fed display rack array, each of the plurality of containers having an arcuate shaped portion thereof and at least one container rotation stop member formed in the arcuate shaped portion of each of the plurality of containers and matingly engaging the container rotation stopping means of the common container track so that each of the plurality of containers positioned along the common container track is stopped from rotation when one of the plurality of containers is removed and the other of the plurality of containers moves forwardly by gravity feed to the forwardly extending dispensing area, each of the plurality of containers further including a bottom portion thereof having a substantially cylindrical shape, the container rotation stop member of each of the plurality of containers further including a pair of spaced-apart grooves extending along a length substantially similar to the length of the bottom portion of each of the plurality of containers to enhance guiding each of the plurality of containers along the first and second track stop members, the bottom portions of each of the plurality of containers positioned to slidably engage the first and second track stop members to prevent rotation of each of the plurality of containers when positioned to advance in a forward direction to the forwardly extending dispensing area.

2. A system as defined in claim 1, wherein each of the plurality of containers has a label positioned on an outer surface of a body portion thereof so that indicia on the label faces forward to be readily viewed by a user in the forwardly extending dispensing area.

3. A system as defined in claim 2, wherein the indicia on the label of each of the plurality of containers faces forward when each of the plurality of containers is inserted into the gravity fed display rack and remains in a forward position when one of the plurality of containers is removed from the forwardly extending dispensing area and another of the plurality of containers advances to the forwardly extending dispensing area by gravity force.

4. A system as defined in claim 3, wherein the label on each of the plurality of containers in the forwardly extending dispensing area faces in a forward direction so that when the plurality of containers in the gravity fed display rack array are serially aligned in the forward most row, the label of each of the plurality of containers faces forward to be readily viewed by a user in the forwardly extending dispensing area.

5. A system as defined in claim 4, wherein the gravity fed display rack includes a forward stop member positioned along a forward movement path of travel of the serially aligned plurality of containers to thereby stop the forward movement of the forward most of the plurality of containers when the forward most of the plurality of containers is positioned adjacent the forwardly extending dispensing area.

6. A system as defined in claim 5, wherein each of the plurality of racks further comprise a bottom support member connected to the first and second substantially parallel track stop members and positioned to abuttingly contact and support the bottom portion of each of the plurality of containers as each of the plurality of containers slidably advance in a forward direction to the forwardly extending dispensing area.

7. The system as defined in claim 1, wherein the first and second track stop members of the container rotation stopping means of at least one of the plurality of racks are detachably connected to the common container track so that the first and second track stop members are positioned to be readily detached from the common container track to thereby accommodate containers having various shapes.

8. The system as defined in claim 1, further comprising at least one common container track adaptor positioned to overlie and abuttingly contact portions of at least one of the plurality of racks so that the gravity fed display rack array is positioned to accommodate containers having various shapes.

9. The system as defined in claim 8, wherein the common container track adaptor has a substantially planar surface positioned to underlie bottom surface portions of each of the plurality of containers having various shapes and is positioned to overlie and abuttingly contact the first and second substantially parallel and spaced-apart track stop members.

10. In combination, a plurality of containers and a container display rack system to prevent rotation of arcuate shaped portions of each of the plurality of containers, the system comprising:

at least one gravity fed display rack having a forwardly extending dispensing area defined by a forward portion of the at least one gravity fed display rack so that gravity force allows each of the plurality of containers when positioned in the at least one gravity fed display rack to advance to the forwardly extending dispensing area when one of the plurality of containers is removed from the forwardly extending dispensing area, the at least one gravity fed display rack including at least one common container track along which each of the plurality of containers serially align, the at least one common container track including container rotation stopping means for stopping rotation of each of the plurality of containers when positioned along the at least one common container track, the container rotation stopping means comprising first and second track stop members extending longitudinally toward the forwardly extending dispensing area along the common container track positioned to matingly engage each of the plurality of containers to prevent rotation of each of the plurality of containers, the first and second track stop members positioned in a spaced apart and substantially parallel relationship to slidably engage a pair of spaced-apart and substantially parallel grooves formed in a bottom portion of each of the plurality of containers to prevent rotation of each of the plurality of containers positioned to advance in a forward direction to the forwardly extending dispensing area;

said plurality of containers positioned in the gravity fed display rack, each of the plurality of containers having an arcuate shaped portion thereof and at least one container rotation stop member formed into the arcuate portion of each of the plurality of containers positioned to matingly engage the container rotation stopping means so that each of the plurality of containers is stopped from rotation when one of the plurality of containers is removed from the forwardly extending dispensing area and each of the plurality of containers advances along the at least one gravity fed display rack to the forwardly extending dispensing area by gravity force.

11. A system as defined in claim 10, wherein each of the plurality of containers has a label positioned on an outer surface of a body portion thereof so that indicia on the label faces forward to be readily viewed by a user in the forwardly extending dispensing area.

12. A system as defined in claim 10, wherein indicia on a label of each of the plurality of containers faces forward when each of the plurality of containers is inserted into the display rack, and remains in a forward position when one of the plurality of containers is removed from the forwardly extending dispensing area and another of the plurality of containers advances to the forwardly extending dispensing area of the rack by gravity force.

13. A system as defined in claim 10, wherein each of the plurality of containers includes a bottom portion thereof having a substantially cylindrical shape, and wherein the container rotation stop member of each of the plurality of containers further includes a pair of grooves extending a length substantially similar to a length of the bottom portion of each of the plurality of containers to enhance guiding each of the plurality of containers when slidably contacting the first and second track stop members.

14. A system as defined in claim 10, wherein the gravity fed display rack includes a forward stop member positioned along a forward movement path of travel of the plurality of containers to thereby stop the forward movement of the forward most of the plurality of containers when the forward most of he plurality of containers is positioned adjacent she forwardly extending dispensing area.

15. A system as defined in claim 10, wherein the at least one gravity fed display rack further comprises a bottom support member connected to the substantially parallel track stop members and positioned to abuttingly contact and support the bottom portion of each of the plurality of containers as the each of the plurality of containers slidably advance in a forward direction to the forwardly extending dispensing area.

16. In combination a container display rack system and at least one container, the system comprising:

a rack having a forwardly extending dispensing area and a common container track along which the container travels forward to the forwardly extending dispensing area, the common container track including container rotation stopping means for stopping the rotation of the container when positioned along the common container track, the container rotation stopping means comprising first and second spaced-apart and substantially parallel track stop members extending longitudinally toward the forwardly extending dispensing area along the common container track positioned to matingly engage the container and prevent rotation of the arcuate shaped portion of the container;

said one container positioned in the rack having an arcuate shaped portion thereof and at least one container rotation stop member positioned to matingly engage the container rotation stopping means of the common container track so that rotation of the at least one container is prevented when positioned in the rack, when the container is positioned to slidably engage the first and second spaced-apart and substantially parallel track stop members of the common container track to prevent rotation of the at least one container when positioned to advance in a forward direction to the forwardly extending dispensing area.

17. A system as defined in claim 16, wherein the container has a label positioned on an outer surface of a body portion of the container so that indicia on the label faces forward to be readily viewed by a user in the forwardly extending dispensing area.

18. A system as defined in claim 16, wherein the at least one container includes a bottom portion thereof having a substantially cylindrical shape, and wherein the container rotation stop member of said at least one container includes a pair of grooves extending a length substantially similar to a length of the bottom portion of said at least one container to enhance guiding said at least one container when slidably contacting the first and second spaced-apart and substantially parallel track stop members.

19. A system as defined in claim 18, wherein the rack includes a forward stop member positioned along a forward movement path of travel of the at least one container positioned to thereby stop the forward movement of the at least one container when the at least one container is positioned adjacent to the forwardly extending dispensing area.

20. A system as defined in claim 19, wherein the rack further comprises a bottom support member connected to the first and second substantially parallel track stop members and positioned to abuttingly contact and support the bottom portion of at least one container as said at least one container slidably advances in a forward direction to the forwardly extending dispensing area.

21. A container rack to prevent rotation of containers positioned in the container rack, the container rack comprising:

a forwardly extending dispensing area defined by a forward portion of the container rack, a common container track along which the containers serially align, the common container track extending longitudinally along the length of the container rack and including container rotation stopping means positioned to abuttingly contact the containers when positioned in the container rack for stopping the rotation of the containers as the containers travel along the common container track, the container rotation stopping means comprising first and second spaced-apart and substantially parallel track stop members extending longitudinally along the length of the common container track toward the forwardly extending dispensing area positioned to matingly engage and prevent rotation of the containers, and a bottom support member connected to the first and second substantially parallel track stop members and positioned to abuttingly contact and support bottom portions of the containers to slidably engage and prevent rotation of the containers, the first and second track stop members each detachably connected to the container rack for ready separation therefrom.

22. A container rack as defined in claim 21, further comprising a forward stop member positioned adjacent the forwardly extending dispensing area to stop forward advancement of the containers as said containers advance to the forwardly extending dispensing area.

23. A container rack as defined in claim 22, wherein the container rack is positioned in a downward angle towards the forwardly extending dispensing area to allow gravity force to advance the containers to said forwardly extending dispensing area.

24. A method of displaying at least one container in a desired position within a container display rack, the method comprising the steps of:

loading at least one container into the container display rack, the container including a top portion having an opening and a substantially flat bottom portion positioned substantially opposite the top portion, and a pair of spaced-apart and substantially parallel grooves positioned along the substantially flat bottom portion of the container;

guiding the at least one container along a common container track to a forwardly extending dispensing area defined by the forward most portion of the container display rack; and preventing rotation of the at least one container by slidably engaging the pair of spaced-apart and substantially parallel grooves positioned along the substantially flat bottom portion of the at least one container with a pair of spaced apart and substantially parallel track stops associated with the common container track.

25. A method as described in claim 24, wherein the step of loading the at least one container further includes positioning said container at the rear most portion in a loading area of the container rack and engaging the at least one container with the common container track.

26. A method as described in claim 25, wherein the step of guiding the at least one container further includes slidably advancing the at least one container along the common container track in a forward direction to a forwardly extending dispensing area.

27. A container rack to prevent rotation of containers positioned in the container rack, the container rack comprising:

a bottom support surface extending from a rear portion of the container rack to a forward portion of the container rack;

a forwardly extending dispensing area defined by forward portions of the container rack;

container rotation stopping means positioned adjacent the bottom support surface for preventing rotation of the containers when positioned to advance to the forwardly extending dispensing area; and detaching means connected to the container rotation stopping means for readily detaching the container rotation stopping means from portions of the container rack, the detaching means including a breakaway member connected to and extending between the container rotation stopping means and portions of the bottom support surface to thereby detachably connect the at least one track stop member to the bottom support surface.

28. A container rack as defined in claim 27, further comprising a pair of opposing sidewalls having upper and lower portions, the lower portions of the sidewalls connected to the bottom support surface and extending upwardly substantially perpendicular to the bottom support surface.

29. A container rack as defined in claim 28, wherein the container rotation stopping means further comprises at least one track stop member extending longitudinally toward the forwardly extending dispensing area adjacent the bottom support surface and positioned to matingly engage the containers to prevent rotation of the containers as the containers advance to the forwardly extending dispensing area.

30. A container rack as defined in claim 29, further comprising at least one common container track positioned to removably overlie the bottom support surface and further positioned adjacent the pair of sidewalls.

31. A container rack to prevent rotation of a plurality of containers positioned in the container rack, the container rack comprising:

a bottom support surface extending from a rear portion of the container rack to a forward portion of the container rack;

a forwardly extending dispensing area defined by the forward portion of the container rack;

container rotation stopping means positioned adjacent the bottom support surface for preventing rotation of the containers when positioned to advance to the forwardly extending dispensing area; and a common container track adaptor positioned to overlie and abuttingly contact the bottom support surface, the common container track adapter having a substantially planar surface positioned to overlie and abuttingly contact the container rotation stopping means so that the container rack can accommodate containers having various shapes.

32. A container rack as defined in claim 31, further comprising a pair of opposing sidewalks having upper and lower portions, the lower portions of the sidewalls connected to the bottom support surface and extending upwardly substantially perpendicular to the bottom support surface.

33. A container rack as defined in claim 32, wherein the container rotation stopping means further comprises at least one track stop member extending longitudinally toward the forwardly extending dispensing area along the bottom support surface and is positioned to matingly engage each of the plurality of containers to prevent rotation as the plurality of containers advance to the forwardly extending dispensed area.

34. In combination, a container display rack system and a plurality of containers, the system comprising:

a gravity fed display rack array having a plurality of racks each positioned adjacent at least one other rack in a side-by-side relationship so that the plurality of racks in combination define a plurality of columns and rows, the gravity fed display rack array also having a rear loading area defined by rear portions of each of the plurality of columns of each of the plurality of racks and a forwardly extending dispensing area defined by forward portions of each of the plurality of columns of the plurality of racks, the forwardly extending dispensing area being positioned at a lower elevation than the rear loading area, each of the plurality of racks including a common container track including container rotation stopping means for stopping the rotation of each of a plurality of containers when positioned along the common container track;

said plurality of containers positioned in each of the plurality of racks of the gravity fed display rack array, each of the plurality of containers having an arcuate shaped portion thereof and at least one container rotation stop member formed in the arcuate shaped portion of each of the plurality of containers and matingly engaging the container rotation stopping means of the common container track so that each of the plurality of containers positioned along the common container track is stopped from rotation when one of the plurality of containers is removed and the other of the plurality of containers moves forward by gravity feed to the forwardly extending dispensing area; and detaching means connected to each of the container rotation stopping means and the common container track for readily detaching selected container rotation stopping means from selected common container tracks.

35. A system as defined in claim 34, wherein the container rotation stopping means further comprises at least one track stop member extending longitudinally toward the forwardly extending dispensing area along the common container track positioned to matingly engage at least one of the containers to prevent rotation of at least one of the containers as the containers advance to the forwardly extending dispensing area.

36. A system as defined in claim 35, wherein the detaching means comprises a break-away member connected between portions of the at least one track stop member and portions of the common container track to thereby detachably connect the at least one track stop member to the common container track.

* * * * *